US007645166B1

(12) United States Patent
Wang

(10) Patent No.: US 7,645,166 B1
(45) Date of Patent: Jan. 12, 2010

(54) CARD CONNECTOR

(75) Inventor: Yao-Ting Wang, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/457,616

(22) Filed: Jun. 17, 2009

(51) Int. Cl.
*H01R 24/00* (2006.01)

(52) U.S. Cl. ..... 439/630; 439/488

(58) Field of Classification Search ..... 439/488, 439/630, 329, 188
See application file for complete search history.

(56) References Cited

U.S. PATENT DOCUMENTS 6,305,960 B1 * 10/2001 Fan ..... 439/630
6,354,881 B1 * 3/2002 Bricaud et al. ..... 439/188
7,074,089 B2 * 7/2006 Kajiura et al. ..... 439/620.01
7,361,035 B1 * 4/2008 Lai ..... 439/155
7,367,828 B2 * 5/2008 Matsukawa et al. ..... 439/160

* cited by examiner

*Primary Examiner*—Briggitte R Hammond
(74) *Attorney, Agent, or Firm*—Rosenberg, Klein & Lee

(57) ABSTRACT

A card connector includes an insulating housing defining a receiving room for receiving a card, a plurality of electrical terminals disposed in the insulating housing and each having a contact portion stretching into the receiving room for electrically contacting a corresponding contact trace of the card, and a monitoring member having a base plate disposed in the insulating housing, a monitoring arm extending along the insertion direction of the card, and a connecting arm connecting the monitoring arm to the base plate. The connecting arm is inclined upward to make the monitoring arm stretched into the receiving room. Both the monitoring arm and the contact portion of one corresponding electrical terminal are aligned with each other along the insertion direction of the card for electrically contacting one same contact trace of the card so as to monitor whether the card is fully inserted in the card connector or not.

9 Claims, 4 Drawing Sheets

CARD CONNECTOR

BACKGROUND OF THE INVENTION

1. Field of the Invention

The present invention relates to a card connector, and more particularly to a card connector capable of monitoring whether a card is fully inserted therein or not.

2. The Related Art

With the development of electronic technology, various electronic cards are widely used in electronic products, such as digital cameras, personal digital assistants (PDA) and mobile phones etc. The conventional electronic product defines a card connector so as to receive a card therein. The card connector includes an insulating housing, a plurality of electrical terminals and a monitoring assembly disposed in the insulating housing respectively. The monitoring assembly includes a rigid first monitoring member and a flexible second monitoring member adapted for being pressed by the card to electrically contact the first monitoring member so as to monitor whether the card is fully inserted in the card connector or not. However, the achievement of the monitoring function of the card connector depends on the cooperation between the first and second monitoring members, so two kinds of molds are needed to shape the monitoring members respectively when manufacturing the card connector. As a result, it takes a relatively high manufacture cost.

SUMMARY OF THE INVENTION

An object of the present invention is to provide a card connector adapted for receiving a card therein which defines a plurality of contact traces thereon each extending along an insertion direction thereof. The card connector includes an insulating housing, a plurality of electrical terminals and a monitoring member. The insulating housing has a base board and two sidewalls extending upward from two opposite side edges of the base board. A receiving room is defined by the base board and the sidewalls for receiving the card therein. The electrical terminals are disposed in the base board of the insulating housing and each has a contact portion stretching into the receiving room for electrically contacting the corresponding contact trace of the card. The monitoring member is disposed in the insulating housing and behind the electrical terminals, which has a flat base plate disposed in a rear of the base board, a monitoring arm extending along the insertion direction of the card, and a connecting arm connecting the monitoring arm to the base plate. The connecting arm is inclined upward to make the monitoring arm stretched into the receiving room. Both the monitoring arm and the contact portion of one corresponding electrical terminal are aligned with each other along the insertion direction of the card for electrically contacting one same contact trace of the card so as to monitor whether the card is fully inserted in the card connector or not. Therefore, only one mold is needed to shape the monitoring member when manufacturing the card connector so that takes a relatively low manufacture cost.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
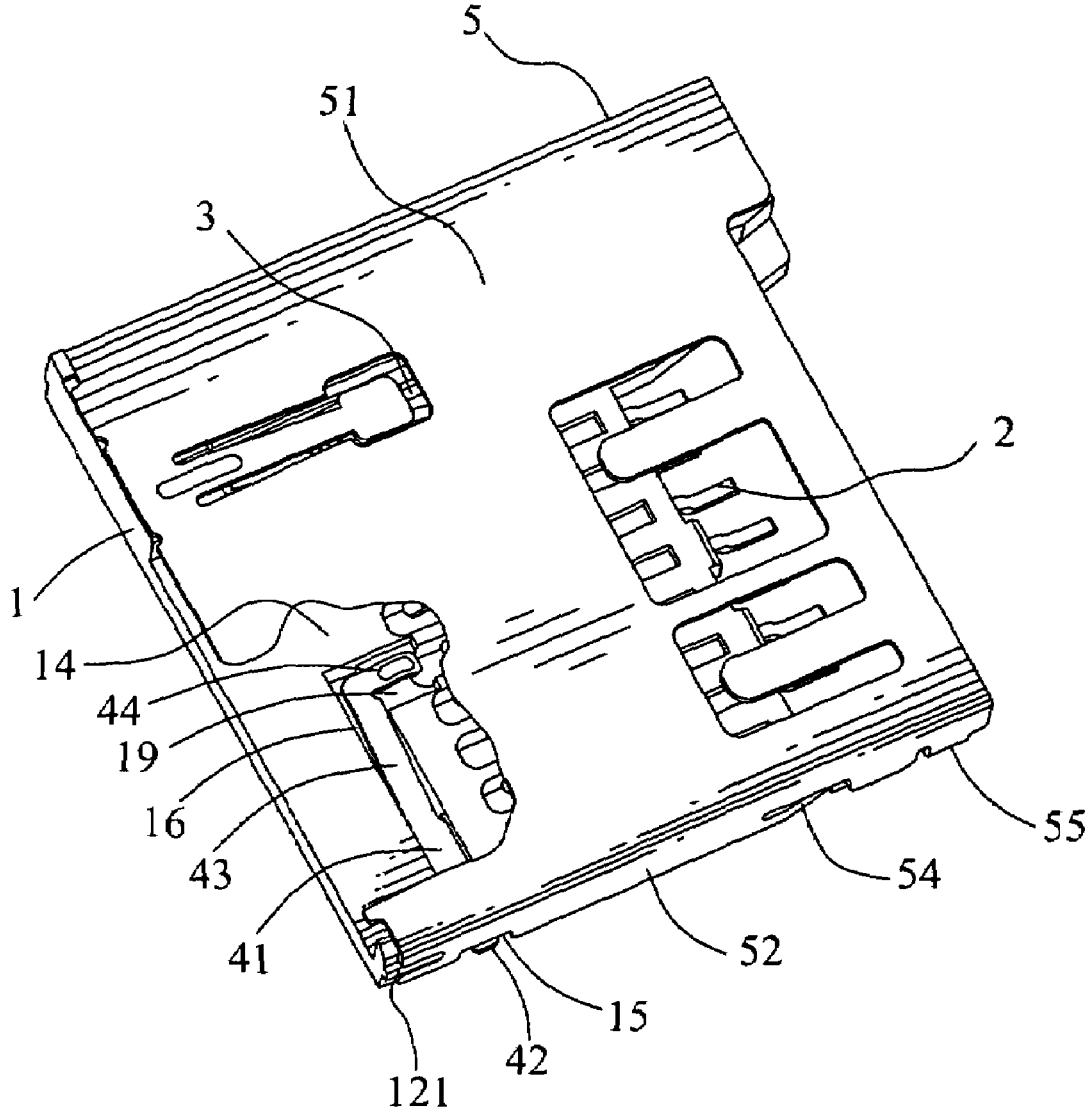
FIG. 1 is a perspective view of a card connector in accordance with the present invention, wherein a cover is partially cut away.
Figure 2:
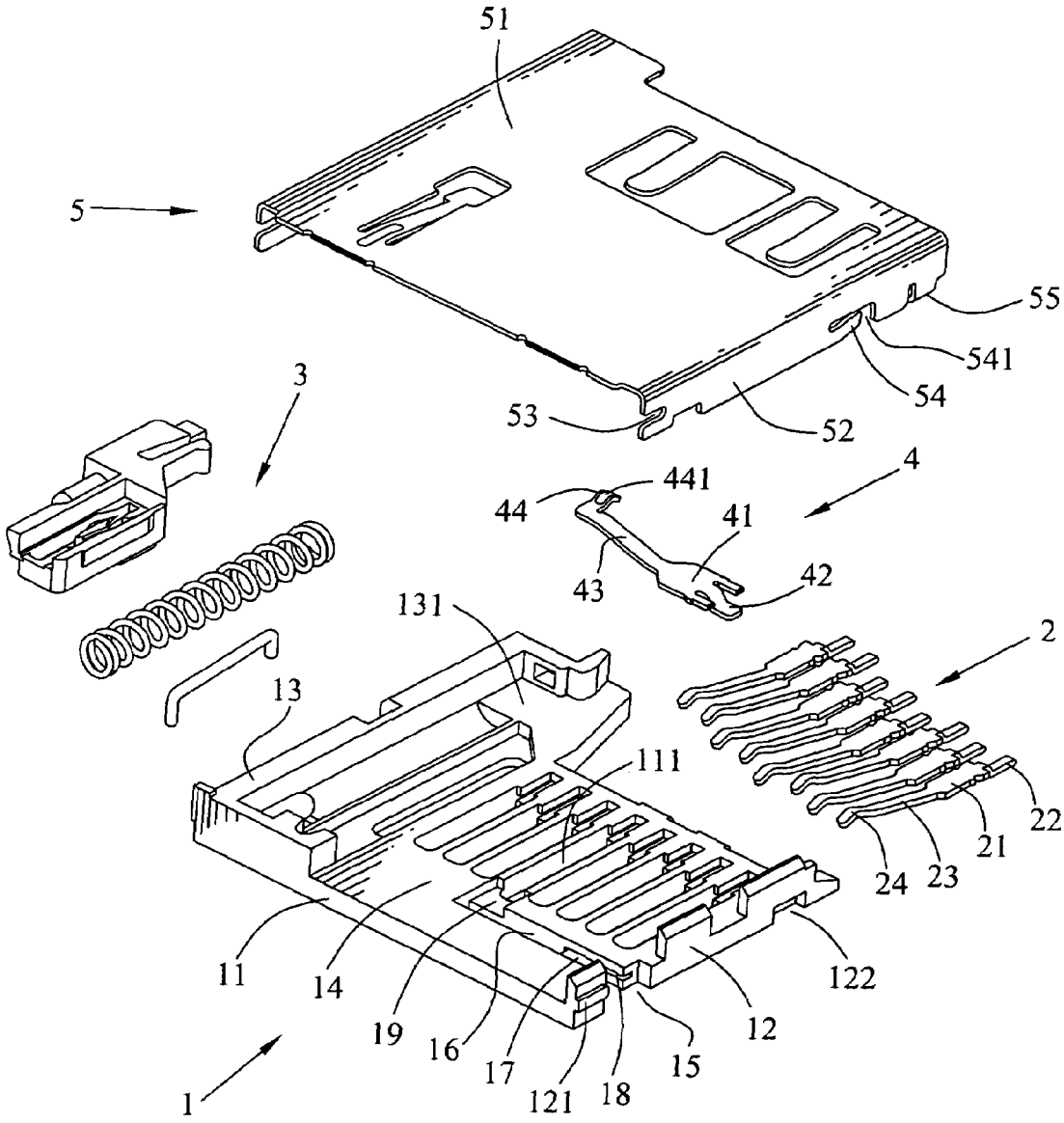
FIG. 2 is an exploded view of the card connector of FIG. 1.

Referring to FIG. 1 and FIG. 2, a card connector in accordance with the present invention includes an insulating housing 1, a plurality of electrical terminals 2, an ejecting device 3, a monitoring member 4 and a cover 5.

Referring to FIG. 2 again, the insulating housing 1 has a rectangular flat base board 11. Two opposite side edges of the base board 11 extend upward to respectively form a restricting sidewall 12 and an accommodating sidewall 13 each extending longitudinally. A receiving room 14 is formed among the base board 11 and the sidewalls 12, 13 for receiving an external card 6 shown in FIG. 4 therein. The accommodating sidewall 13 defines an accommodating recess 131 extending longitudinally to face the restricting sidewall 12 and communicating with the receiving room 14 for receiving the ejecting device 3 therein. A front of the base board 11 defines a plurality of terminal passageways 111 arranged at regular intervals along a transverse direction thereof and each extending longitudinally to communicate with the receiving room 14. An outside of each of the sidewalls 12, 13 protrudes outward to form a locking rib 121 at a rear end thereof, and is further provided with a fastening groove 122 at a front thereof.

The restricting sidewall 12 is further severed by a notch 15 at a rear thereof and in front of the locking rib 121. A rear of the base board 11 defines a receiving cavity 16 extending transversely behind the terminal passageways 111 and vertically passing therethrough to communicate with the receiving room 14. A top of one end of the receiving cavity 16 further extends transversely to form a holding fillister 17 connected with the notch 15. Two opposite sides of a bottom of the holding fillister 17 oppositely extend sideward into the base board 11 to form a pair of fixing slots 18. A top of the other end of the receiving cavity 16 far away from the notch 15 extend forward to form a receiving fillister 19 aligned longitudinally with one corresponding terminal passageway 111 and communicating with the receiving room 14.

In FIG. 2, each of the electrical terminals 2 has a flat base portion 21. A front edge of the base portion 21 is bent downward and then extends forward to form a soldering portion 22. A rear edge of the base portion 21 extends rearward and is inclined upward to form an elastic arm 23. A free end of the elastic arm 23 is further arched upward to form a contact portion 24.

Figure 3:
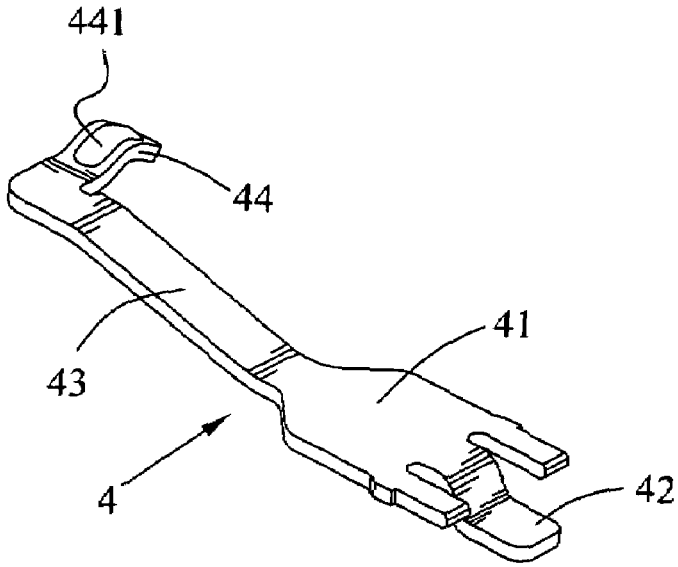
FIG. 3 is perspective view of a monitoring member of the card connector of FIG. 1.

Referring to FIG. 3, the monitoring member 4 has a rectangular flat base plate 41. A middle of one side edge of the base plate 41 is bent downward and then extends sideward to form a soldering tail 42 opposite to the base plate 41. A middle of the other side edge of the base plate 41 extends toward an opposite direction to the soldering tail 42 and is inclined upward to form a connecting arm 43 having a flat free end. One side edge of the free end of the connecting arm 43 extends toward a perpendicular direction to the connecting arm 43 and is arched upward to form a monitoring arm 44. A contact apex 441 is protruded upward across an arched portion of the monitoring arm 44.

Referring to FIG. 2 again, the cover 5 has a rectangular flat top board 51. Two opposite side edges of the top board 51 extend downward to form two side boards 52. Each of the side boards 52 defines a locking slit 53 at a rear end thereof, and an opening 541 at a front thereof. A rear edge of the opening 541 extends forward and is inclined inward to form an elastic strip 54. A bottom edge of a front end of each of the side boards 52 is bent inward to form a soldering foot 55 in front of the elastic strip 54.

Referring to FIG. 1 and FIG. 2 again, in assembly, the base portion 21 and the elastic arm 23 of each of the electrical terminals 2 is disposed in the corresponding terminal passageway 111 of the insulating housing 1. The soldering portion 22 stretches out of a front edge of the base board 11 for being soldered to a printed circuit board (not shown), and the contact portion 24 stretches into the receiving room 14. The ejecting device 3 is mounted in the accommodating recess 131 for withdrawing the card 6 from the card connector shown in FIG. 5. The base plate 41 of the monitoring member 4 is held in the holding fillister 17 of the insulating hosing 1 and two opposite sides thereof are inserted in the respective fixing slots 18. The soldering tail 42 stretches into the notch 15 for being soldered to the printed circuit board. The connecting arm 43 is received in the receiving cavity 16, and the monitoring arm 44 stretches into the receiving room 14 and is hanged above the receiving fillister 19, wherein the monitoring arm 44 is longitudinally aligned with one corresponding electrical terminal 2 and located behind the contact portion 24. The cover 5 is coupled on the insulating housing 1. The locking ribs 121 are snapped in the respective locking slits 53 and the elastic strips 54 are buckled in the respective fastening grooves 122. The soldering foot 55 is located under the corresponding sidewall 12/13 for being soldered to the printed circuit board. The contact apex 441 of the monitoring arm 44 of the monitoring member 4 is paced from a bottom surface of the top board 51 of the cover 5 before the card 6 is inserted into the receiving room 14 of the card connector.

Figure 4:
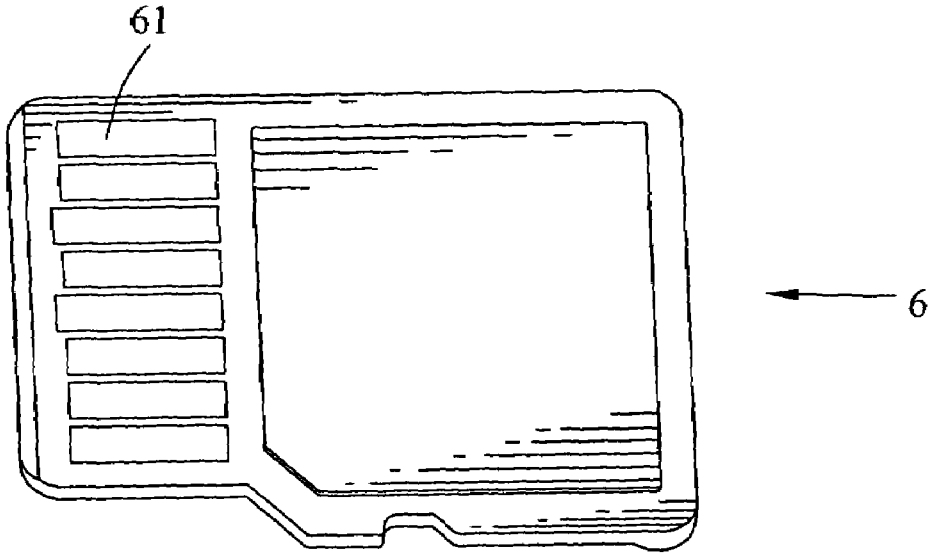
FIG. 4 is a perspective view of an external card capable of being inserted in the card connector of FIG. 1.
Figure 5:
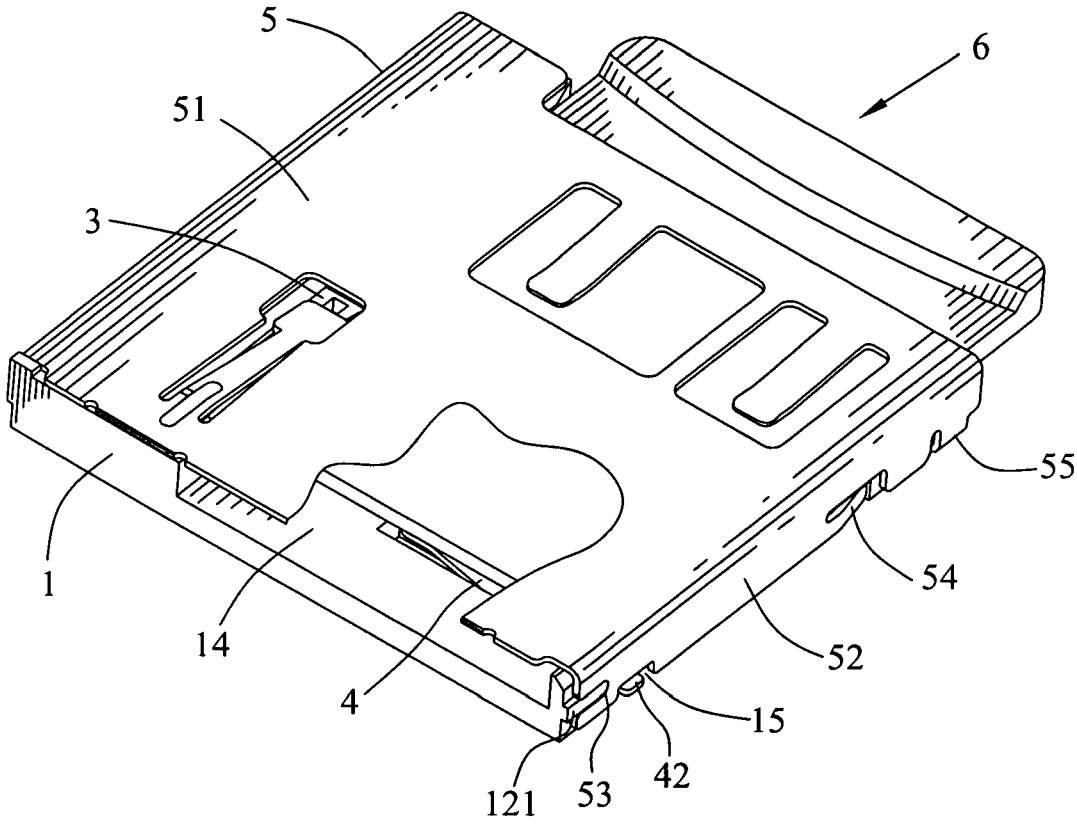
FIG. 5 is a perspective view of the card connector with the cutaway cover of FIG. 1, in which the card shown in FIG. 4 is inserted.
Figure 6:
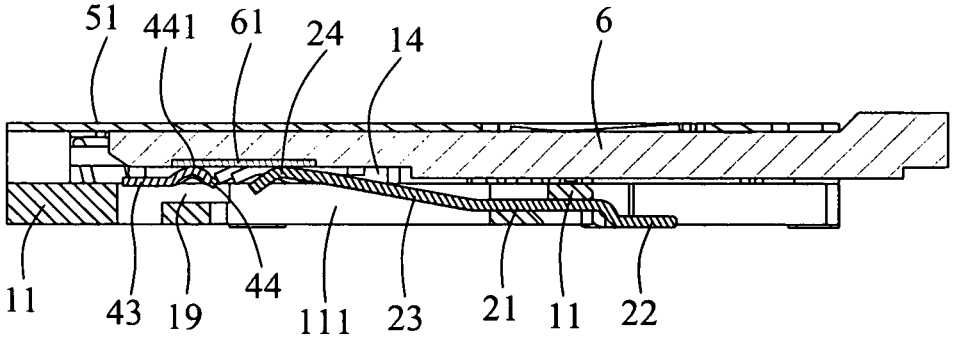
FIG. 6 is a cross-sectional view of the card connector with the card of FIG. 5.

Referring to FIGS. 4-6, a rear of a contact surface of the card 6 defines a plurality of contact traces 61 thereon arranged at regular intervals along a transverse direction thereof and each extending longitudinally. When the card 6 is inserted into the receiving room 14 of the card connector, the contact portions 24 of the electrical terminals 2 electrically contact the corresponding contact traces 61 of the card 6. Moreover, one of the contact traces 61 of the card 6 further electrically contact the contact apex 441 of the monitoring arm 44 for forming an electrical connection between the monitoring member 4 and the corresponding electrical terminal 2 so as to monitor whether the card 6 is fully inserted in the card connector or not. At this moment, the monitoring arm 44 of the monitoring member 4 is pressed downward by the card 6 partially into the receiving fillister 19.

As described above, the monitoring member 4 is electrically connected with the corresponding electrical terminal 2 by means of both the contact apex 441 and the corresponding contact portion 24 electrically contacting one same contact trace 61 of the card 6 so as to monitor whether the card 6 is fully inserted in the card connector or not. Therefore, only one mold is needed to shape the monitoring member 4 when manufacturing the card connector so that takes a relatively low manufacture cost.

What is claimed is:

1. A card connector adapted for receiving a card therein which defines a plurality of contact traces thereon each extending along an insertion direction thereof, the card connector comprising:

an insulating housing having a base board and two sidewalls extending upward from two opposite side edges of the base board, a receiving room being defined by the base board and the sidewalls for receiving the card therein;

a plurality of electrical terminals disposed in the base board of the insulating housing and each having a contact portion stretching into the receiving room for electrically contacting the corresponding contact trace of the card; and a monitoring member disposed in the insulating housing behind the electrical terminals, the monitoring member having a flat base plate disposed in a rear of the base board, a monitoring arm extending along the insertion direction of the card, and a connecting arm connecting the monitoring arm to the base plate, the connecting arm being inclined upward to make the monitoring arm stretched into the receiving room, wherein both the monitoring arm and the contact portion of one corresponding electrical terminal are aligned with each other along the insertion direction of the card for electrically contacting one same contact trace of the card.

2. The card connector as claimed in claim 1, wherein the monitoring arm of the monitoring member is arched upward, and a contact apex is protruded upward across an arched portion of the monitoring arm for electrically contacting the corresponding contact trace of the card.

3. The card connector as claimed in claim 1, wherein the connecting arm of the monitoring member extends transversely to perpendicularly connect one end of the monitoring arm to the base plate.

4. The card connector as claimed in claim 3, wherein one side edge of the base plate is bent downward and then extends toward an opposite direction to the connecting arm to form a soldering tail, one of the sidewalls is severed by a notch at a rear thereof, the soldering tail stretches into the notch.

5. The card connector as claimed in claim 4, wherein the rear of the base board defines a receiving cavity extending transversely and communicating with the receiving room for receiving the connecting arm of the monitoring member therein, a top of one end of the receiving cavity further extends transversely to form a holding fillister connected with the notch for holding the base plate therein, a top of the other end of the receiving cavity extends along the insertion direction of the card to form a receiving fillister for receiving the monitoring arm therein.

6. The card connector as claimed in claim 5, wherein two opposite sides of a bottom of the holding fillister oppositely extend sideward into the base board to form a pair of fixing slots for snapping two opposite sides of the base plate of the monitoring member therein.

7. The card connector as claimed in claim 1, wherein each of the electrical terminals further has a flat base portion, one end edge of the base portion extends toward the monitoring member along the insertion direction of the card and is inclined upward to form an elastic arm, the contact portion is formed by a free end of the elastic arm being arched upward, the other end edge of the base portion is bent downward and then extends toward an opposite direction to the elastic arm to form a soldering portion stretching out of a front edge of the base board of the insulating housing.

8. The card connector as claimed in claim 1, further comprising a cover coupled on the insulating housing, the cover having a top board covered on the receiving room, two opposite side edges of the top board extending downward to form two side boards, a bottom edge of each of the side boards being bent inward to form a soldering foot located under the respective sidewall.

9. The card connector as claimed in claim 8, wherein an outside of each of the sidewalls protrudes outward to form a locking rib and further defines a fastening groove apart from the locking rib, each of the side boards of the cover defines a locking slit for snapping the corresponding locking rib therein, and an elastic strip extended forward and inclined inward to be buckled in the corresponding fastening groove.

* * * * *